US005965338A

United States Patent [19]

Visconte et al.

[11] Patent Number: 5,965,338

[45] Date of Patent: Oct. 12, 1999

[54] COLOR PHOTOGRAPHIC ELEMENT

[75] Inventors: Gary W. Visconte; Alfred B. Fant, both of Rochester; Yongcai Wang, Penfield, all of N.Y.

[73] Assignee: Eastman Kodak Company, Rochester, N.Y.

[21] Appl. No.: 09/039,042

[22] Filed: Mar. 13, 1998

[51] Int. Cl.[6] ..... G03C 1/30; G03C 7/26

[52] U.S. Cl. ..... 430/507; 430/502; 430/503; 430/505; 430/509; 430/621; 430/622

[58] Field of Search ..... 430/502, 503, 430/509, 621, 622, 505, 507

[56] References Cited

U.S. PATENT DOCUMENTS 5,219,715 6/1993 Sowinski et al. ..... 430/505

5,362,616 11/1994 Edwards et al. ..... 430/505

*Primary Examiner*—Richard L. Schilling

*Attorney, Agent, or Firm*—Carl F. Ruoff

[57] ABSTRACT

This invention contemplates a multilayer, multicolor photographic element comprising a support, a plurality of dye-forming hydrophilic colloid containing silver halide emulsion layers which are spectrally sensitized to different regions of the visible spectrum including at least one blue-sensitive emulsion layer, a green-sensitive emulsion layer, and a red-sensitive emulsion layer wherein the topmost silver halide emulsion layer has a water swell percentage which is greater than any other light-sensitive emulsion layer.

17 Claims, No Drawings

COLOR PHOTOGRAPHIC ELEMENT

CROSS REFERENCE TO RELATED APPLICATIONS

This application relates to commonly assigned copending application Ser. No. 09/039,047, filed simultaneously herewith and hereby incorporated by reference for all that it discloses.

FIELD OF THE INVENTION

This invention relates to a multilayer, multicolor photographic element that contains a hardener with improved sensitometric properties.

BACKGROUND OF THE INVENTION

It is conventional practice to form photographic elements by forming on a support one or more photographically active layers. Typically these photographically active layers contain silver halide dispersed in a hydrophilic colloid, such as gelatin, to form an emulsion. In multi-layer photographic elements used in color photography there are at least three selectively sensitive color-forming units each made up of one or more emulsion layers coated on one side of a photographic support, such as film or paper. The color forming units are typically rendered variously responsive to the red, green and blue regions of the spectrum. The blue-sensitive color-forming unit typically contains a yellow coupler, the green-sensitive color forming unit a magenta coupler and the red-sensitive color forming unit a cyan coupler. In an alternative form color couplers are not initially present in the photographic element, but are introduced during processing after an image forming exposure. Hydrophilic colloid subbing layers, interlayers and protective layers are also typically present. The blue-sensitive color forming unit forms preferably the outermost unit, and a yellow filter layer normally overlies the green and the red sensitive color forming units to protect them against residual blue light not absorbed in the blue-sensitive color forming unit. Multi-layer photographic elements used in color photography of this general type and processes for their preparation are well known in the art.

An alternative color dye forming color photographic element can also be formed from a plurality of light sensitive silver halide emulsion layers wherein each light sensitive silver halide emulsion layer is sensitized to the entire visible spectrum and comprises cyan dye forming couplers, magenta dye forming couplers and yellow dye forming couplers. The object of this photographic element is to produce a neutral record suitable for producing black and white prints. These films are typically referred to as chromogenic films and are processed by conventional color negative film processors.

It is conventional practice to incorporate into photographic hydrophilic colloid layers addenda, referred to as hardeners, having as their purpose the reduction or elimination of the susceptibility of such colloid layers to wet abrasion, swelling in aqueous solutions and softening at elevated temperatures. Wet abrasion, swelling and softening are of primary concern during processing, especially in those instances where it is desired to accelerate processing by resort to elevated temperatures. Gelatin containing layers that are not treated with a hardening agent generally have poorer water resistance, heat resistance, and wet abrasion resistance.

After exposure to light, the photographic element is processed chemically to reveal a usable image. The chemical processing entails two fundamental steps. The first is the treatment of the exposed silver halide with a color developer wherein some or all of the silver halide is reduced to metallic silver while an organic dye is formed from the oxidized color developer. The second is the removal of the silver metal thus formed and of any residual silver halide by the desilvering steps of (1) bleaching, wherein the developed silver is oxidized to silver salts; and (2) fixing, wherein the silver salts are dissolved and removed from the photographic material. The bleaching and fixing steps may be performed sequentially or as a single step. The overall rate of development is influenced by swelling of the gelatin layer and diffusion rate of different chemical species into and out of the swollen emulsion layers. The diffusion coefficient value and emulsion layer swelling thickness increases with processing temperature and decreases with increasing hardness of the gelatin. When emulsion layer is hardened, the decrease in diffusivity is partially offset by the decrease in the swelling thickness and hence the decrease in diffusion pathlength. Therefore under given processing conditions, there is an optimum emulsion layer hardness for achieving desirable optical density or contrast or photographic speed. For this reason, it is desirable that the hardening reaction be complete shortly after layer formation. That is, the coatings attain their complete functionality, based on hardening, immediately after manufacture. This avoids changes in photographic properties as a result of the so-called "after-hardening".

Afterhardening causes sensitized photographic materials to be held until the completion of hardening, at which time, the best sensitometric corrections are made. However, the corrections may vary with coating events, manufacturing processes, and significantly increase manufacturing cycle time and cost. Many efforts have been made to develop fast acting hardeners to allow coatings to reach their maximum hardness at the time of coating. However, fast acting hardeners are known to initiate viscosity increase and premature gelation that lead to disruptions in the coating process.

From an environmental point of view, it is desirable to reduce the amount of silver, couplers, and solvents incorporated in the emulsion layers to lower chemical usage and reduce undesirable effluents. In addition, it is highly desirable to process a photographic material as rapidly as possible, and an accelerated process is constantly being sought.

The object of this invention is to provide a multilayer, multicolor photographic element that has well-balanced water swelling values in each dye-forming hydrophilic colloid containing silver halide emulsion layer, that has improved sensitometric properties immediately after manufacturing, has lower chemical usage, and has reduced afterhardening effect during storage of the element.

SUMMARY OF THE INVENTION

This invention contemplates a multilayer, multicolor photographic element comprising a support, a plurality of dye-forming hydrophilic colloid containing silver halide emulsion layers which are spectrally sensitized to different regions of the visible spectrum including at least one blue-sensitive emulsion layer, a green-sensitive emulsion layer, and a red-sensitive emulsion layer wherein the topmost silver halide emulsion layer has a water swell percentage which is greater than any other light-sensitive emulsion layer.

The present invention also contemplates a multilayer photographic element including a support, a plurality of dye-forming hydrophilic colloid containing silver halide emulsion layers which are each spectrally sensitized to all regions of the visible spectrum. One of the silver halide emulsion layers is a topmost silver halide emulsion layer having a water swell percentage which is greater than any other light-sensitive emulsion layer.

DESCRIPTION OF PREFERRED EMBODIMENTS

The multilayer, multicolor photographic elements of this invention typically contain dye image-forming layers sensitive to each of the three primary regions of the visible spectrum. Each layer can comprise a single emulsion layer or of multiple emulsion layers sensitive to a region of the spectrum. The layers of the element can be arranged in various orders as known in the art. A typical multicolor photographic element comprises a support bearing a cyan dye image-forming layer comprising at least one red-sensitive silver halide emulsion layer having associated therewith at least one cyan dye-forming coupler, a magenta dye image-forming layer comprising at least one green-sensitive silver halide emulsion layer having associated therewith at least one magenta dye-forming coupler, and a yellow dye image-forming layer comprising at least one blue-sensitive silver halide emulsion layer having associated therewith at least one yellow dye-forming coupler.

The element typically contains additional layers, such as filter layers, interlayers, overcoat layers, subbing layers, and the like. All of these can be coated on a support which can be transparent or reflective. Photographic elements in accordance with the present invention may also include a transparent magnetic recording layer such as a layer containing magnetic particles. The total dry thicknesses of the all hydrophilic colloid layers of the color photographic material depends on the silver halide emulsion contained, the coupler, the oily agent, the additive, etc., and a preferable film thickness of all the emulsion layers varies from 5 to 35 $\mu$m, preferably from 10 to 30 $\mu$m.

The multilayer, multicolor photographic elements of this invention can vary greatly in regard to the type of the support. Typical supports include cellulose nitrate film, cellulose acetate film, poly(vinyl acetal) film, polystyrene including syndiotatic polystyrene film, polycarbonate film, poly(ethylene terephthalate) film, poly(ethylene naphthalate) film, glass, metal plate, paper, polymer coated paper, and the like. The support may be annealed.

In one of the preferred embodiments, the layer constitution of the multilayer, multicolor photographic elements according to the present invention comprises, coated successively from the support, a colloidal silver antihalation layer, a cyan dye image-forming layer, an interlayer, a magenta dye image-forming layer, an interlayer, a colloidal silver yellow filter layer, a yellow dye image-forming layer, an ultraviolet ray absorbing layer, and a protective overcoat layer.

In the following discussion of layer structures, the red sensitive layer includes a antihalation layer, a cyan dye image-forming layer which comprises a plurality of low speed and high speed layers, and an interlayer; the green sensitive layer includes a magenta dye image forming layer which comprises a plurality of low speed and high speed layers, and a yellow filter layer, the blue sensitive layer includes a yellow dye image-forming layer which comprises a plurality of low speed and high speed layers, an ultraviolet ray absorbing layer, and a protective overcoat layer. The layer constitution of the multilayer, multicolor photographic elements then comprises, coated successively from the support, the red sensitive layer, the green sensitive layer, and the blue sensitive layer. The blue sensitive layer constitutes the top-most silver halide emulsion layer.

According to the present invention, the blue sensitive layer has a water swell percentage that is greater than the red sensitive layer or the green sensitive layer. Photographic elements with such layer structures demonstrate improved sensitometric properties immediately after manufacturing and reduced afterhardening effect during storage of the elements. The water swell percentage of a layer is defined as $$(\alpha D/D)\times 100$$

where D represent the dry thickness of the layer, and $\Delta D$ represents the increase in thickness due to water swelling over the dry thickness of the layer. The swelling of the layer can be measured, for example, by dipping the silver halide photographic materials in distilled water at 20° C. for 5 minutes. The water swell percentage of all the light sensitive layers is preferably 250% or less, most preferably from 50 to 200%. If the water swell percentage exceeds 250%, the wet mechanical strength becomes significantly reduced. Also, if the water swell percentage is less than 50%, the developing and fixing speeds are greatly reduced to adversely affect the sensitometric properties.

The water swell percentage of each light sensitive layer, that is, the blue sensitive layer, the green sensitive layer, and the red sensitive layer can be determined by coating each layer separately on a support. The water swell percentage of each light sensitive layer in a multilayer, multicolor photographic element can be determined by using enzyme digesting technique in combination with the swell measurement. The dry film thickness is measured at 20° C. and a controlled humidity of 50%. For each layer thickness, the cross-section of the dried sample is photographed with enlargement by a scanning electron microscope for measurement of the film thickness of each layer.

Any suitable hydrophilic polymers can be used as binder to form each light sensitive layer. They include, for example, naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

When gelatin is used as the film forming binder, an inorganic or organic gelatin hardener can be used singly or in combination to control the water swell percentage of each light sensitive layer. Such hardeners have been described in Research Disclosure No. 38957, pages 599–600, Published by Kenneth Mason Publications, Ltd., Dudley Annex, 12 North Street, Emsworth, Hampshire P010 7DQ, ENGLAND, September, 1996. The art has recognized distinct advantages to the utilization of vinylsulfonyl compounds as hardeners for the hydrophilic colloid layers of photographic elements. Such compounds are characterized by the inclusion of a plurality of vinylsulfonyl groups. In perhaps the simplest possible structural form, divinylsulfone, a single sulfonyl group joins two vinyl groups. Most typically a plurality of vinylsulfonylalkyl groups, such as vinylsulfonylmethyl, ethyl, propyl or butyl groups, are joined through an intermediate ether, amine, diamine or hydrocarbon linkage. Bis(vinylsulfonyl) ethers such as bis(vinylsulfonylmethyl) and bis (vinylsulfonylethyl) ethers, N,N-methylene-bis((â-vinylsulfonyl) propionamide) have been found particularly suitable for use as hardeners. Representative vinylsulfonyl hardeners as well as procedures for their synthesis and use are disclosed in Bumess et al. U.S. Pat. Nos. 3,490,911, issued Jan. 20, 1970; 3,539,644, issued Nov. 10, 1970, and 3,642,486, issued Feb. 15, 1972, the disclosures of which are incorporated by reference. Other ways to control the water swell percentage of each light sensitive layer are to place a different amount of hardener in each light sensitive layer, or to use a hydrophilic polymer in a particular layer to increase its swelling rate, or to use layer selective-hardening technology by placing in a particular layer a polymeric hardener, or a hardener reactive polymer, or a modified gelatin such as an amine-derivatized gelatin, and the like.

It is desirable to make each light-sensitive layer a thin layer. For example, it is possible to reduce the amount of the hydrophilic colloid used in each layer. Since a hydrophilic colloid is added for the purpose of maintaining coupler fine oil droplets, etc. dissolved in silver halide or a high boiling solvent, or preventing fog elevation due to mechanical stress, and also for preventing color turbidity due to diffusion of the developing agent oxidized product between layers, etc., its amount can be reduced within the range which does not impair those purposes.

Another method for making the layer thinner is to use a coupler of high color formability.

Other methods of making the layer thinner include reducing the amount of the high boiling point solvent and reducing the interlayer layer thickness by addition of a scavenger of the developing agent oxidized product in the intermediate layer between the layers having different color sensitivities, etc.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DEAR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, the dye-image-providing material can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The photographic element of the present invention can contain at least one electrically conductive layer, which can be either a surface protective layer or a sub layer. The surface resistivity of at least one side of the support is preferably less than $1\times10^{12}$ Ω/□, more preferably less than $1\times10^{11}$ Ω/□ at 20° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The photographic elements of the invention can be prepared by any of a number of well-know coating techniques, such as dip coating, rod coating, blade coating, air knife coating, gravure coating and reverse roll coating, extrusion coating, slide coating, curtain coating, and the like. Known coating and drying methods are described in further detail in Research Disclosure No. 308119, Published Dec. 1989, pages 1007 to 1008.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The present invention will now be described in detail with reference to examples; however, the present invention should not limited by these examples.

EXAMPLES

A series of photographic elements are prepared as follows: An poly(ethylene naphthalate) support is used having an antistatic layer overcoated with a transparent magnetic layer on the other side. The support is coated on the side opposite to the antistatic layer with the layers having compositions as follows:

Antihalation layer: The antihalation comprises gelatin (1.6 g/m$^2$), filamentary metallic silver (0.15 g/m$^2$), compound AHU-1 (0.0253 g/m$^2$), AHU-2 (0.13 g/m$^2$), AHU-3 (0.0108 g/m$^2$), S-1 (0.086 g/m$^2$), triethylhexyl phosphate (0.0108 g/m$^2$), UV-1 (0.108 g/m$^2$), UV-2 (0.108 g/m$^2$), and S-4 (0.216 g/m$^2$).

Interlayer: This layer comprises compound 2,5-di-t-octyl-1, 4-dihydroxy benzene (0.075 g/m$^2$), tri(2-ethylhexyl) phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 $\mu$m grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 $\mu$m grain size) (0.816 g/m$^2$ silver) and a red sensitive, tabular grain, silver bromoiodide emulsion (4.5 mole percent iodide) (0.98 $\mu$m diameter by 0.11 $\mu$m thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 $\mu$m diameter by 0.11 $\mu$m thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer: This layer comprises compound 2,5-di-t-octyl-1, 4-dihydroxy benzene (0.075 g/m$^2$), tri(2-ethylhexyl) phosphate (0.113 g/m$^2$), and gelatin (0.86 g/m$^2$).

The above six layers are coated as cyan dye image-forming layer.

Slow Magenta Dye-forming Layer: This layer comprises a blend of a green sensitive, tabular grain, silver bromoiodide emulsion (1.5 mole percent iodide) (0.7 $\mu$m diameter by 0.112 $\mu$m thick) (0.258 g/m$^2$ Ag), and a green sensitive, tabular grain, silver bromoiodide emulsion (1.3 mole percent iodide) (0.54 $\mu$m diameter by 0.086 $\mu$m thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 $\mu$m diameter by 0.12 $\mu$m thick) (0.646 g/m$^2$ Ag), compound M-1 (0.099 gtm$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 $\mu$m diameter by 0.113 $\mu$m thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises compound 2,5-di-t-octyl-1,4-dihydroxy benzene (0.075 g/m$^2$), YD-2 (0.108 g/m$^2$), Irganox 1076 sold by Ciba Geigy (0.01 g/m$^2$), S-2 (0.121 g/m$^2$) and Gelatin (0.861 g/m$^2$).

The above four layers are coated as magenta dye image-forming layer.

Slow Yellow Dye-forming Layer: This layer comprises a blend of a blue sensitive, tabular grain, silver bromoiodide emulsion (4.5 mole percent iodide) (1.4 $\mu$m diameter by 0.131 $\mu$m thick) (0.161 g/m$^2$ Ag), a blue sensitive, tabular grain, silver bromoiodide emulsion (1.5 mole percent iodide) (0.85 $\mu$m diameter by 0.131 $\mu$m thick) (0.0.108 g/m$^2$ Ag), and a blue sensitive, tabular grain, silver bromoiodide emulsion (1.3 mole percent iodide) (0.54 $\mu$m diameter by 0.086 $\mu$m thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 gm diameter by 0.128 $\mu$m thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

Second Protective Layer: This layer comprises gelatin (0.7 g/m$^2$), colloidal silver (0.215 g/m$^2$), UV-1 (0.108 g/m$^2$), UV-2 (0.108 g/m$^2$), and S-1 (0.151 g/m$^2$)

First Protective Layer: This layer comprises gelatin (0.888 g/m$^2$) Silicone lube (DC-200 Dow Corning, 0.0401 g/m$^2$), Fluorad FC-134 (3M Co., 0.0039 g/m$^2$), Aerosol OT (American Cyanamide, 0.0215 g/m$^2$), Surfactant Olin 10G (Olin Corp.,0.0272 g/m$^2$), Poly(methyl methacrylate) matte (1.5 $\mu$m, 0.0538 g/m$^2$), and Poly(methyl methacrylate-co-methacrylic acid) (45/55 wt %, 2.7 $\mu$m, 0.107 g/m$^2$).

The above four layers are coated as yellow dye image-forming layer.

Y1

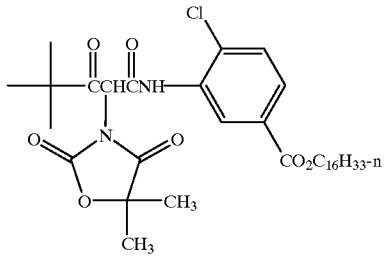

-continued
IR-1
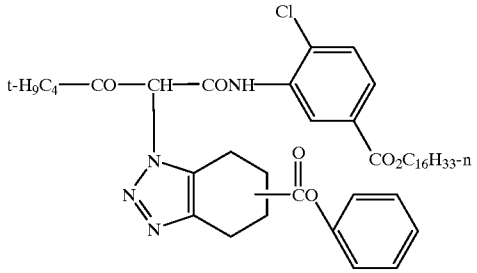
YD-2
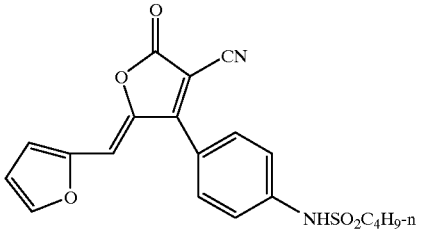
ST-1
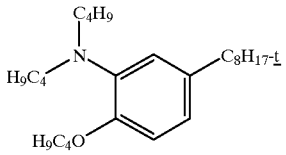
IR-2
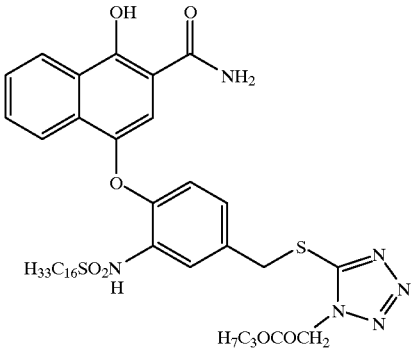
IR-3
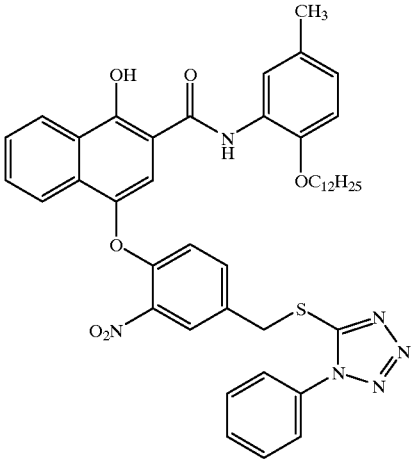

-continued
IR-4
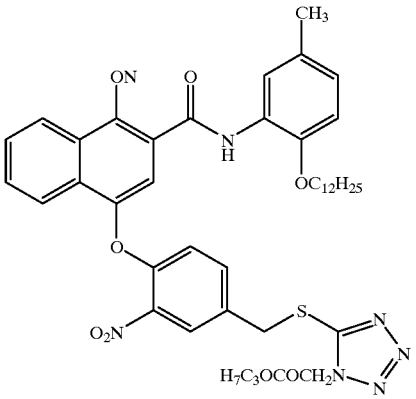
B-1
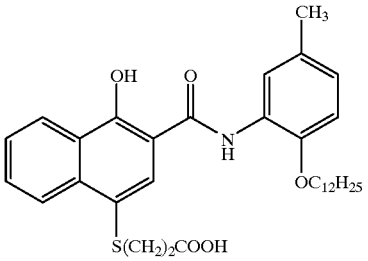
M-1
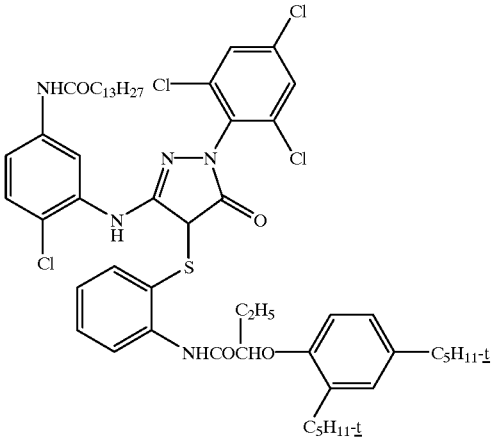

-continued
MM-1
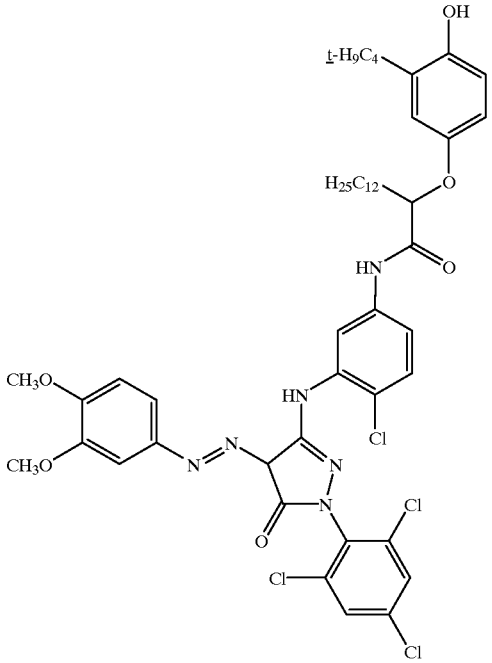
CC-1
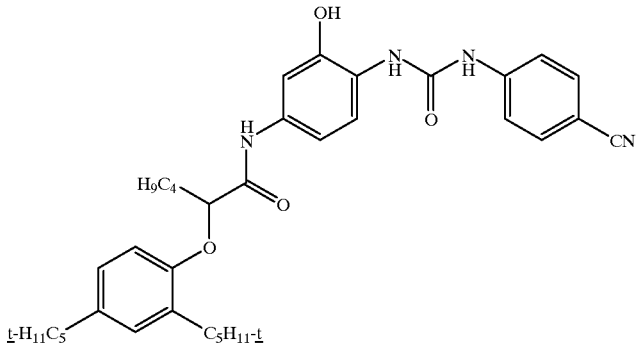
CM-1
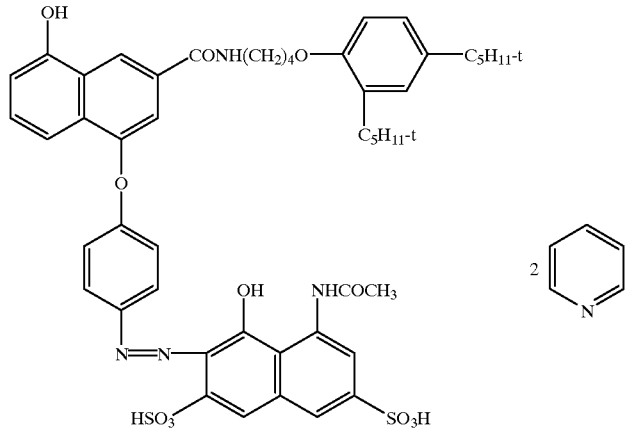
S-1
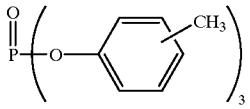

-continued
S-2
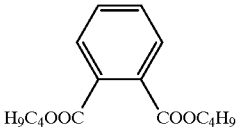
S-3
$C_{11}H_{23}CON(C_2H_5)_2$
S-4
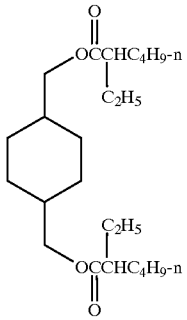
S-5
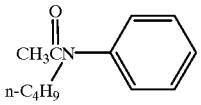
AHU-1
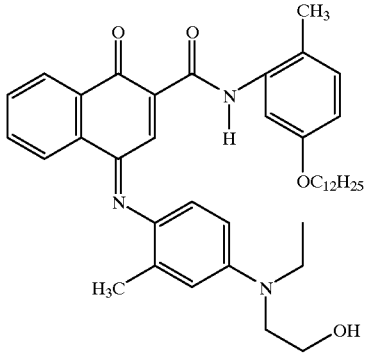
AHU-2
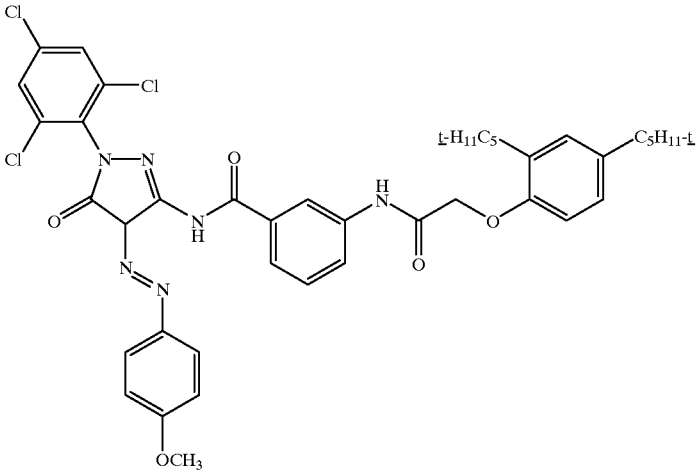

-continued

AHU-3

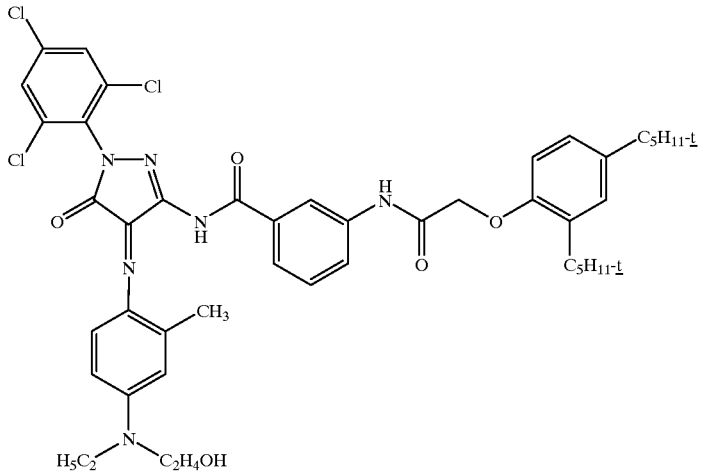

(UV-1)

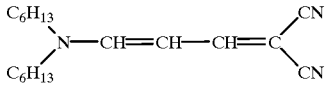

(UV-2)

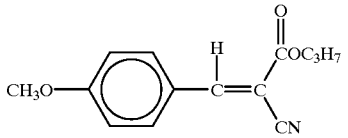

In this example the yellow dye image-forming layer is the topmost emulsion layer. According to the present invention, the yellow dye image-forming layer has a water swell percentage greater than both magenta dye image-forming layer and cyan dye image-forming layer. The water swell percentage of each light sensitive layer is controlled in the present invention examples by distributing bis(vinyl sulfone) methane hardener between antihalation layer which is the bottom layer of cyan dye image-forming layer and slow yellow layer which is the bottom layer of yellow dye image-forming layer.

Two strips of each photographic element prepared, 35 mm×305 mm, are then exposed in a manner similar to that described in International Standard ISO 5800, "Photography Color negative film for still photography—Determination of ISO speed" and processed, The resulting 21 step tablet exposures are read using Status M filters, again in a manner similar to that described in International Standard ISO 5800. The density values of the individual steps in the stepped exposure are recorded. Step 1 is the lowest film transmission density, step 21 is the highest film transmission density. The average density of steps 15 through 20 for red, green and blue transmission density are calculated. The average density change for red, green, and blue light sensitive layers is reported in Table 1 in reference to the average density values found for Comparative Example 1. Significant gains in density for each light sensitive layer are found for the photographic element prepared in accordance with the present invention.

TABLE 1

| Photographic element | Water swell percentage | | | Average density change | | |
|---|---|---|---|---|---|---|
| | Blue | Green | Red | Blue | Green | Red |
| Example 1 (Comparison) | 133% | 156% | 153% | — | — | — |
| Example 2 (Invention) | 170% | 155% | 148% | +0.043 | +0.138 | +0.096 |
| Example 3 (Invention) | 198% | 154% | 146% | +0.060 | +0.172 | +0.128 |

Two strips of each photographic element prepared, 35 mm×305 mm, are conditioned at 37.8° C. and 50% RH for one week. The average density for red, green, and blue light transmission is measured by the above described method. The average density change for each photographic element is then calculated for red, green, and blue light sensitive layers in comparison to the values for the same photographic element which is not conditioned. The average density is decreased by 0.056, 0.05, and 0.044 for red, green, and blue light sensitive layers for Comparative Example 1. The average density is decreased by about 0.03, 0.034, and 0.05 for red, green, and blue light sensitive layers for Invention Example 2. The Average density is decreased by about 0.017, 0.031, and 0.029 for red, green, and blue light sensitive layers for Invention Example 3. The photographic elements prepared in accordance with the present invention have showed much less changes in sensitometric properties during conditioning.

The invention has been described in detail with particular reference to certain preferred embodiments thereof, but it will be understood that variations and modifications can be effected within the spirit and scope of the invention.

What is claimed is:

1. A photographic element comprising:

a support;

a plurality of dye-forming hydrophilic colloid containing silver halide emulsion layers which are spectrally sensitized to different regions of the visible spectrum including at least one blue-sensitive emulsion layer, at least one green-sensitive emulsion layer, and at least one red-sensitive emulsion layer wherein one of the silver halide emulsion layers comprises a topmost silver halide emulsion layer having a water swell percentage which is greater than any other light-sensitive emulsion layer.

2. The photographic element of claim 1 further comprising:

a protective overcoat superposed on the topmost silver halide emulsion layer.

3. The photographic element of claim 1 further comprising:

a filter layer superposed on the support.

4. The photographic element of claim 1 further comprising:

a subbing layer superposed on the support.

5. The photographic element of claim 1 further comprising:

a transparent magnetic recording layer superposed on the support.

6. The photographic element of claim 1 further comprising:

an antistatic layer superposed on the support.

7. The photographic element of claim 1 wherein the support is selected from the group consisting of cellulose nitrate film, cellulose acetate film, poly(vinyl acetal) film, polystyrene film, polycarbonate film, poly(ethylene terephthalate) film, poly(ethylene naphthalate) film, glass, metal plate, paper, polymer and coated paper.

8. The photographic element of claim 1 wherein the blue-sensitive emulsion layer is the topmost silver halide emulsion layer.

9. The photographic element of claim 1 further comprising a vinyl sulfone compound as a hardener.

10. A photographic element comprising:

a support;

a plurality of dye-forming hydrophilic colloid containing silver halide emulsion layers which are each spectrally sensitized to all regions of the visible spectrum, wherein one of the silver halide emulsion layers comprises a topmost silver halide emulsion layer having a water swell percentage which is greater than any other light-sensitive emulsion layer.

11. The photographic element of claim 10 further comprising:

a protective overcoat superposed on the topmost silver halide emulsion layer.

12. The photographic element of claim 10 further comprising:

a filter layer superposed on the support.

13. The photographic element of claim 10 further comprising:

a subbing layer superposed on the support.

14. The photographic element of claim 10 further comprising:

a transparent magnetic recording layer superposed on the support.

15. The photographic element of claim 10 further comprising:

an antistatic layer superposed on the support.

16. The photographic element of claim 10 wherein the support is selected from the group consisting of cellulose nitrate film, cellulose acetate film, poly(vinyl acetal) film, polystyrene film, polycarbonate film, poly(ethylene terephthalate) film, poly(ethylene naphthalate) film, glass, metal plate, paper, polymer and coated paper.

17. The photographic element of claim 10 further comprising a vinyl sulfone compound as a hardener.

* * * * *